US006871435B2

(12) United States Patent
Yoshida

(10) Patent No.: US 6,871,435 B2
(45) Date of Patent: Mar. 29, 2005

(54) CARD HOLDER

(75) Inventor: Tsukasa Yoshida, Tokyo (JP)

(73) Assignee: NS Planning Inc., Tokyo (JP)

( * ) Notice: Subject to any disclaimer, the term of this patent is extended or adjusted under 35 U.S.C. 154(b) by 0 days.

(21) Appl. No.: 10/311,278

(22) PCT Filed: Aug. 6, 2001

(86) PCT No.: PCT/JP01/06748

§ 371 (c)(1),
(2), (4) Date: Mar. 3, 2003

(87) PCT Pub. No.: WO02/11999

PCT Pub. Date: Feb. 14, 2002

(65) Prior Publication Data

US 2003/0172570 A1 Sep. 18, 2003

(30) Foreign Application Priority Data

Aug. 7, 2000 (JP) ..... 2000-239105
Dec. 28, 2000 (JP) ..... 2000-402407

(51) Int. Cl.[7] ..... G09F 3/20
(52) U.S. Cl. ..... 40/658; 40/611.12
(58) Field of Search ..... 40/658, 792, 793, 40/611.12, 617

(56) References Cited

U.S. PATENT DOCUMENTS 3,955,296 A * 5/1976 Kapstad ..... 40/658
4,097,971 A * 7/1978 Morris ..... 40/1.5
5,845,889 A * 12/1998 Suzuki ..... 248/451

FOREIGN PATENT DOCUMENTS

JP 5-475 1/1993
JP 10-144183 5/1998
JP 10-114183 * 6/1998 ..... B42F/9/00
JP 11-042878 2/1999

* cited by examiner

*Primary Examiner*—S. Joseph Morano
*Assistant Examiner*—Robert J. McCarry, Jr.
(74) *Attorney, Agent, or Firm*—Sughrue Mion, PLLC

(57) ABSTRACT

A basic piece having a thick potion has its end engaged with an outer covering piece so as to provide a card insertion opening formed on one side portion. A card pinching piece having elasticity is disposed in a space between the basic piece and the outer covering piece and attached to the outer covering piece such that one end of the card pinching piece abuts against the basic piece.

6 Claims, 8 Drawing Sheets

(a)

(b)

CARD HOLDER

TECHNICAL FIELD

The present invention relates to card holders used for pinching or holding cards such as memo papers, price lists, or the like on shelves in stores, on walls of houses, inside vehicles, or in other facilities.

BACKGROUND ART

Conventionally, various types of such card holders have been developed, for example those as shown in FIG. 14 and FIG. 15. A card holder illustrated in FIG. 14 has a roller individually inserted in an outer covering member. A card holder illustrated in FIG. 15 includes a flat disc-shaped member, and the disc-shaped member has a side portion of its periphery opened, into which a card is inserted to be held. However, these conventional card holders are time consuming and expensive to manufacture, fail to smoothly attach and detach cards to be pinched, or limit a thickness of the card to be held. Additionally, most of the conventional card holders like that shown in FIG. 15 can only be used in limited places including the interior of a vehicle and hence lacks in general versatility.

The present invention has been accomplished in view of the aforesaid technical background, and it is an object of the present invention to provide a card holder that permits smooth attachment and detachment of any card without limiting a thickness of the card to be pinched, whose manufacturing costs are low, and which has ruggedness and enhanced versatility.

DISCLOSURE OF THE INVENTION

According to the present invention, there is provided a card holder comprising a basic piece having a thick portion, an outer covering piece engaged with one end of the basic piece so as to provide a card insertion opening on one side portion of the basic piece, and a card pinching piece having elasticity and disposed in a space formed by the basic piece and the outer covering piece, the card pinching piece being attached to the outer covering piece such that one end of the card pinching piece abuts against the basic piece. The outer covering piece has hook-shaped basic-piece engaging portions protruding therefrom and which engage with inner and outer ends of the thick portion of the basic piece. Furthermore, the basic piece further comprises a base for engagement with a card, and the thick portion is formed by folding from one end of the base, so that the basic piece is formed to have a L-shaped cross-section. Also, the outer covering piece comprises a basic-piece attachment portion for engaging with the thick portion of the basic piece, an outer covering surface formed by folding from the basic-piece attachment portion, and an outer covering end having a half-round cross-section, so that the outer covering piece is formed to have a J-shaped cross-section, and the card pinching piece is attached to a back surface of the outer covering surface. Accordingly, the card pinching piece is attached inside the space, thus providing the card holder having a simple structure and ruggedness. The basic piece and the outer covering piece are assembled together after attaching the card pinching piece, thereby to facilitate manufacturing the card holder.

The card holder has a part of the base of the basic piece made of softer material than the others. This hopefully provides stronger pinching ability.

In this card holder, the card pinching piece is made of elastic material such as rubber, and comprises an attachment portion for attachment to the outer covering piece and formed to have a linear cross-section, a leg protruding from the attachment portion, and a pinching portion extending from one end of the leg, one end of the pinching portion serving as a basic-piece abutting portion for abutting against the basic piece and sloped in a direction of the card insertion opening. The pinching portion extends from the end of the leg in a trapezoid shape. Furthermore, the basic-piece abutting portion has its tip end formed in a stepped shape, and the tip end has arc-shaped pits and projections formed in a mutually staggered configuration. These features permit the card holder to have sufficient ruggedness to be applicable to a variety of thicknesses, and also allow smooth insertion, reliable pinching, and smooth drawing of the card.

The card pinching piece is composed of a plate spring, one end portion of which is the attachment portion for attachment to the outer covering piece, and a card pinching portion is formed by folding the plate spring with a slope from one end of the attachment portion, so that the card pinching piece is formed in a mountain-like shape. This makes the structure of the card holder simple, and allows the smooth pinching and drawing of the card.

One end of the card pinching portion is further folded to form a pinching protrusion. In more detail, the attachment portion has claw-like projections disposed on and extending from respective left and right sided ends of the plate spring in a width direction, and the one end of the card pinching portion is further folded to form the pinching protrusion. The attachment portion has its end or boundary folded back. This permits the smooth attachment and detachment of the card.

BEST MODE FOR CARRYING OUT THE INVENTION

Hereinafter some preferred embodiments of the present invention will be described in detail with reference to the accompanying drawings. FIGS. 1 to 7 show sectional views of a first preferred embodiment. A card holder of the present invention, indicated at 1, includes a basic piece 2 made of hard synthetic resin or metal such as aluminum, an outer covering piece 3 integrally fitted into the basic piece 2 and made of hard synthetic resin or metal such as aluminum, and a pinching piece 4 disposed inside a space between the basic piece 2 and the outer covering piece 3 and made of elastic material. The card holder is formed as a long member that is to be cut to an appropriate length.

The basic piece 2, which is made of the hard synthetic resin, is formed to have a L-shaped cross-section. The basic piece 2 includes a base 2*a* having a linear cross-section. A thick portion 2*b* is formed by folding from one end or border of the base 2*a* at the right angle. One end portion of the basic piece is further folded, and then the tip end thereof is folded again in a hook-shape, to form an outer-covering-piece engaging portion 2*c*, which is the hook-shaped tip end. In the vicinity of the thick portion 2*b* is formed a recess 2*d* having a trapezoid-shaped cross-section. Another outer-covering-piece engaging portion 2*e* is provided facing inward with respect to the recess. A part from a tip end of the base 2*a* to a middle point thereof has its surface portion made of slightly softer synthetic resin 2*f* than the others, and this part is a little thicker than the others.

The outer covering piece 3, which is made of the hard synthetic resin, is formed to have a J-shaped cross-section. The outer covering piece 3 includes a basic-piece attachment portion 3*a* disposed so as to face the thick portion 2*b* of the basic piece 2. An outer covering surface 3*b* is formed by folding from the basic-piece attachment portion 3*a* at the right angle to have a linear cross-section. On a tip of the outer covering surface 3*b* portion is formed an outer covering tip end 3*c* having a half-round cross-section. On both inner and outer ends of the basic-piece attachment portion 3*a* are outwardly protruded hook-shaped basic-piece engaging portions 3*d* and 3*d* each of which has a L-shaped cross-section. On the back of the outer covering surface 3*b*, a small protrusion 3*e* for aligning the card pinching piece and having a linear cross-section is provided in the vicinity of the basic-piece attachment portion 3*a*. In contrast, near the tip of the outer covering surface 3*b* portion is provided another small protrusion 3*f* for aligning the card pinching piece and having a L-shaped cross-section. The outer covering end 3*c* has its head folded inward.

Figure 1:
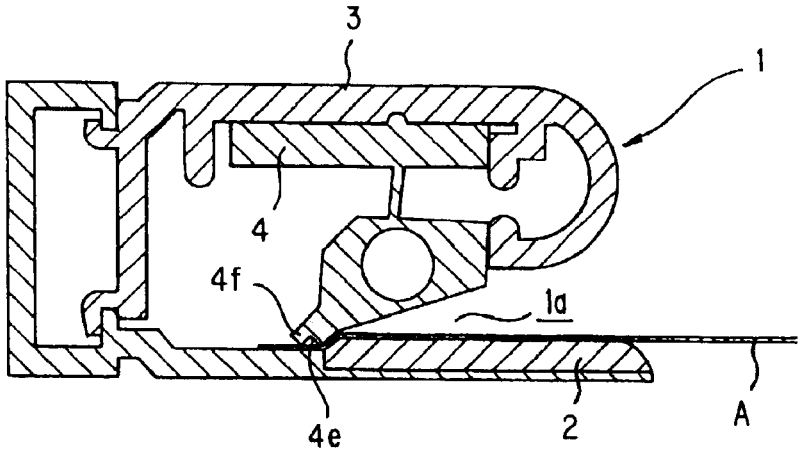
FIG. 1 is a sectional view showing an operating state of a card holder according to a first preferred embodiment of the present invention.
Figure 2:
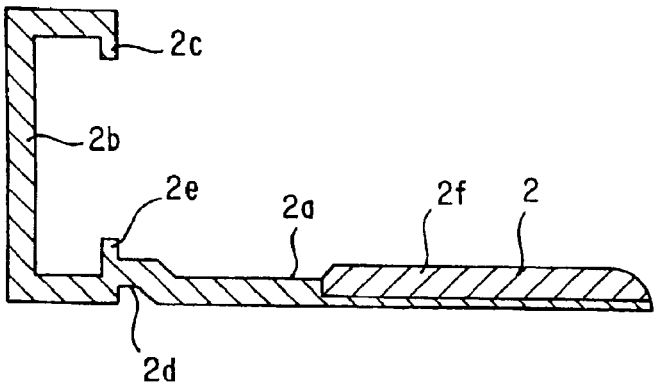
FIG. 2 is a sectional view of a basic piece according to the first preferred embodiment.
Figure 3:
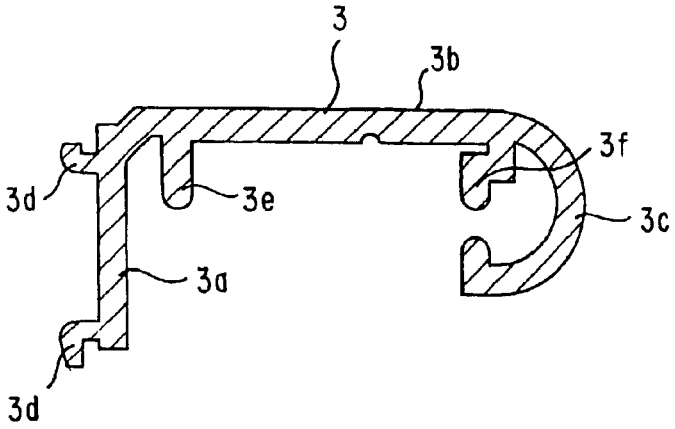
FIG. 3 is a sectional view of an outer covering piece according to the first preferred embodiment.
Figure 4:
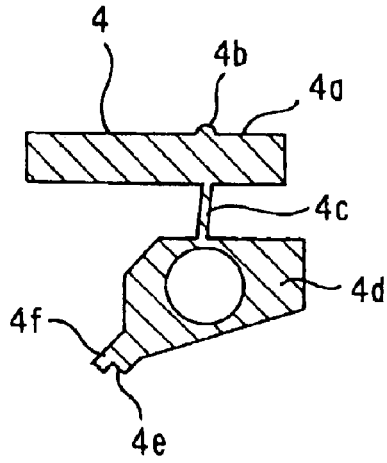
FIG. 4 is a sectional view of a card pinching piece according to the first preferred embodiment.
Figure 5:
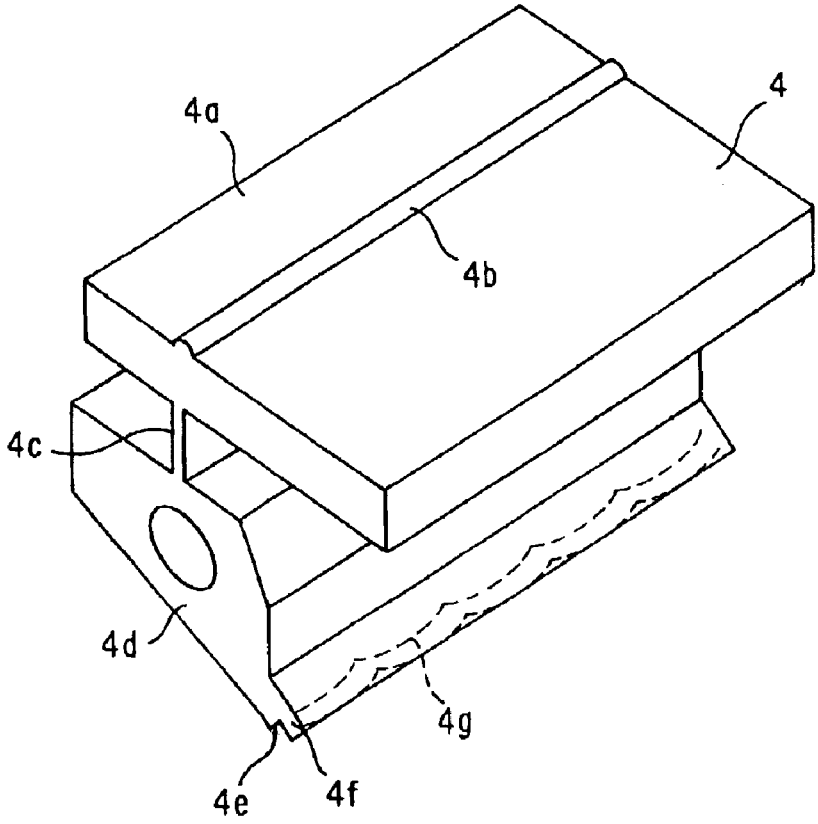
FIG. 5 is a perspective view of the card pinching piece according to the first preferred embodiment.
Figure 6:
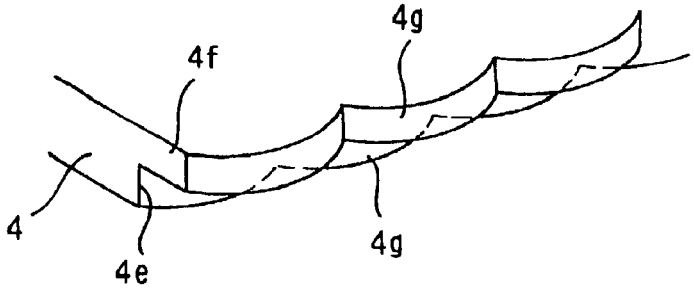
FIG. 6 is a partially perspective view of the card pinching piece according to the first preferred embodiment.

The card pinching piece 4 is made of elastic material such as chloroprene rubber, silicone rubber, or the like to be formed so as to have a prescribed length. This card pinching piece 4 is disposed and attached in a space formed by the basic piece 2 and the outer covering piece 3 with a predetermined space therefrom. An attachment portion 4*a* having a linear cross-section is provided with a small protrusion 4*b* formed at the middle point thereof. From a side opposite to the small protrusion 4*b*, is protruded a leg 4*c* which slopes slightly inward. And from the end of the leg 4*c*, a pinching portion 4*d* is extended. This pinching portion 4*d* is formed around a base of the leg 4*c* to have a substantially trapezoid-shaped cross-section. Further, the pinching portion 4*d* has its end sloped in a direction of the card insertion, and on a tip end or head of the pinching portion, cutouts are formed to provide double-stepped abutting portions 4*e* and 4*f*. Preferably the tip end with these abutting portions 4*e* and 4*f* formed thereon, as shown in FIG. 6, has respective arc-shaped pits and projections 4*g* formed in a mutually staggered configuration.

Figure 7:
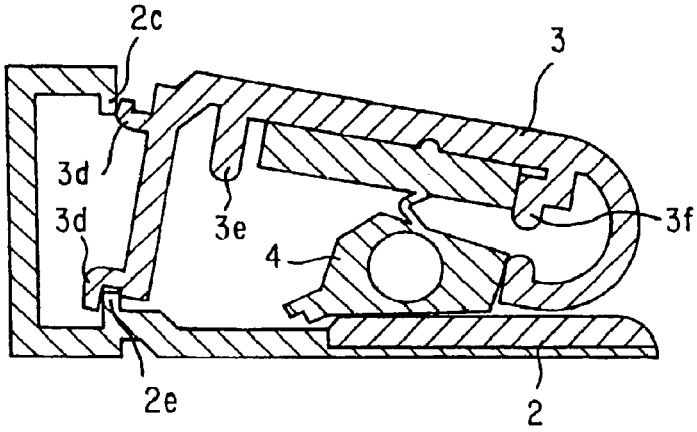
FIG. 7 is a perspective view showing a state of an assembly according to the first preferred embodiment.

Now the card holder 1 of the present invention having the above-mentioned parts will be manufactured as follows. First, the attachment portion 4*a* of the card pinching piece 4 is attached to the outer covering piece 3 between the small protrusions 3*e* and 3*f* provided on the back of the outer covering surface 3*b* of the outer covering piece 3 for aligning the pinching piece, with the small protrusion 4*b* fitted into a small recess formed on the outer covering piece 3. Subsequently as shown in FIG. 7, with the outer covering piece 3 inclined, the basic-piece engaging portion 3*d* provided on the inner side is engaged with the outer covering engaging portion 2*e* of the basic piece 2, and then the outer covering piece 3 is slightly rotated, so that the basic-piece engaging portion 3*d* provided on the outer side is engaged with the outer-covering-piece engaging portion 2*c* of the basic piece 2. At this time, the base 2*a* of the basic piece 2 is parallel to the outer covering surface 3*b* of the outer covering piece 3, and the pinching protrusions 4*e* and 4*f* of the card pinching piece is brought into abutment against the part of the basic piece 2. A space formed between the outer covering tip end 3*c* and the tip of the basic piece 2 serves as a card insertion opening 1*a*, into which a card A is inserted to be then pinched by the card pinching piece 4 and the basic piece 2, whereby the card is retained. Finally onto the back of the basic piece 2 is fixed a double-faced tape (not shown), thus facilitating attaching the card holder to an utensil and the like.

Figure 8:
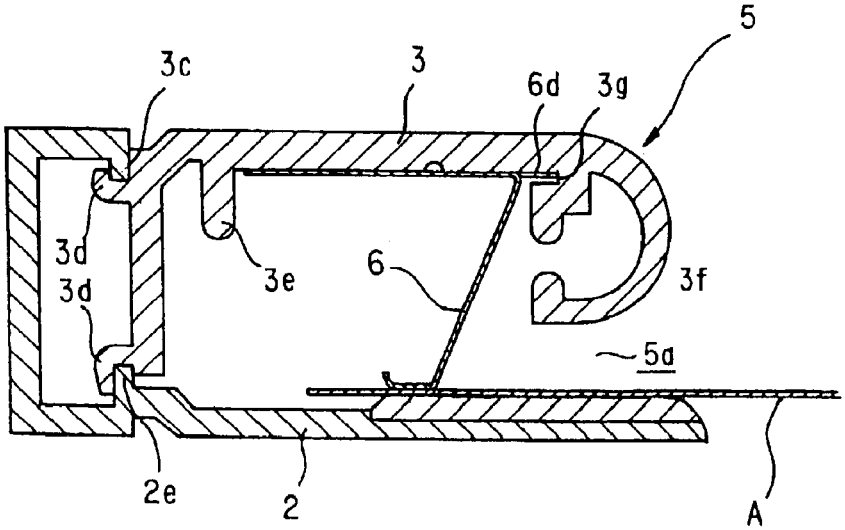
FIG. 8 is a sectional view showing an operating state of a card holder according to a second preferred embodiment of the present invention.
Figure 9:
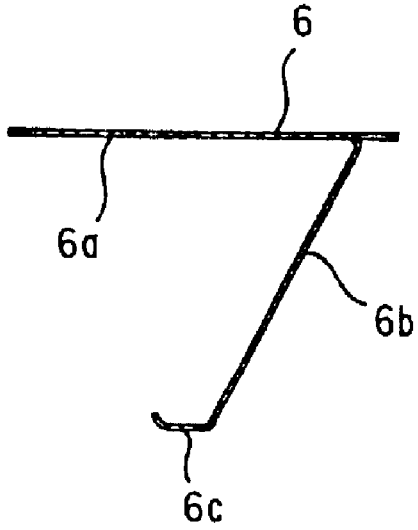
FIG. 9(*a*) is a sectional view of a plate spring according to the second preferred embodiment, and FIG. 9(*b*) is a perspective view thereof.
Figure 9:
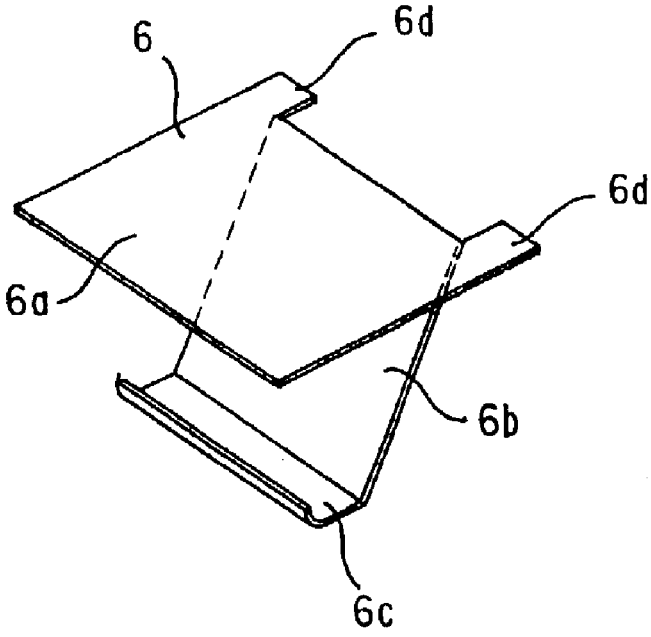

FIG. 8 and FIG. 9 show a second preferred embodiment. In this embodiment, the same basic piece 2 and the outer covering piece 3 as those of the first embodiment are utilized, but a plate spring 6 is substituted for the card pinching piece 4 of the first embodiment.

The plate spring 6 is made of elastic material including metal such as stainless steel, and is formed in a mountain-like shape as shown in FIG. 9. The plate spring 6 includes an attachment portion 6*a* having a linear cross-section. The plate spring 6 is folded with a slope from one end of the attachment portion 6*a* inward to form a card pinching portion 6*b*. Further one end of the card pinching portion 6*b* is folded in parallel with the attachment portion 6*a* to form a pinching protrusion 6*c*. The attachment portion 6*a* has claw-like projections 6*d* and 6*d* disposed on and extending from respective left and right sided ends thereof in a width direction.

The above-mentioned plate spring 6 has claw-like projections 6*d* inserted into a groove 3*g* that is disposed in the small protrusion 3*f* for aligning the outer covering piece 3, so that the plate spring is attached to the back surface of the outer covering piece 3. At this time, the tip of the plate spring 6, namely the card pinching protrusion 6*c* is brought into abutment against the basic piece 2. The card A is inserted into the card insertion opening 5*a* to be pinched by the basic piece 2 and the plate spring 6, whereby the card is retained.

Figure 10:
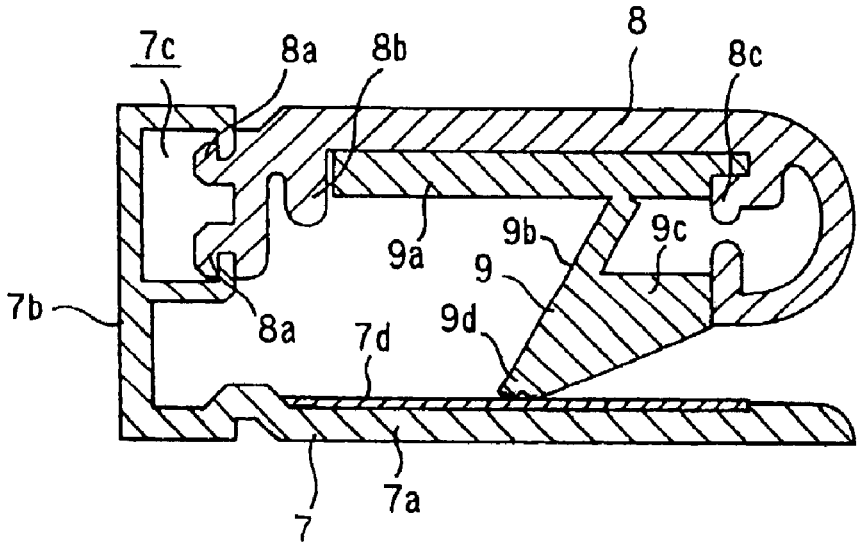
FIG. 10 is a sectional view of a card holder according to a third preferred embodiment of the present invention.
Figure 11:
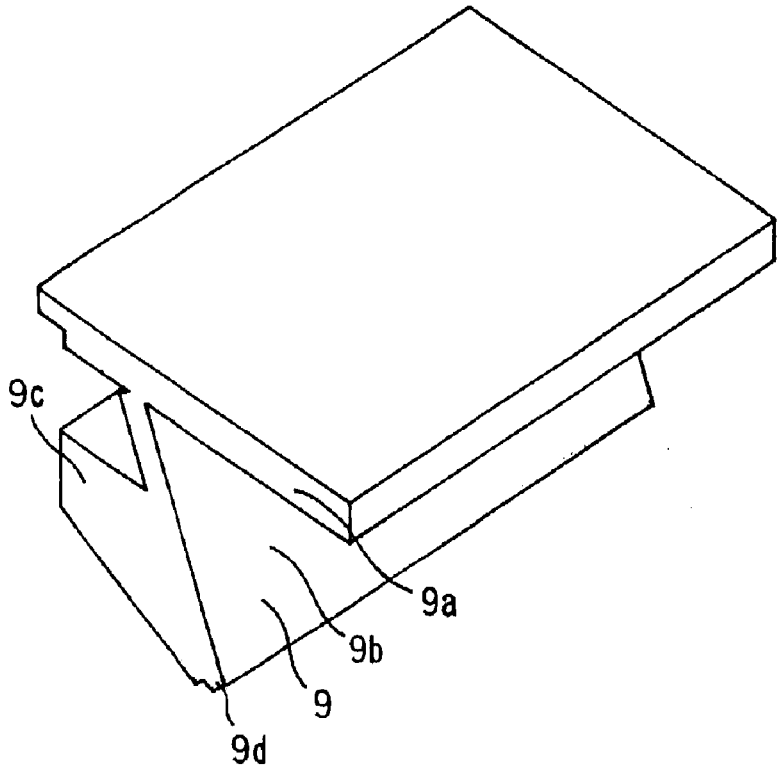
FIG. 11 is a perspective view of a card pinching piece according to the third preferred embodiment.

FIG. 10 and FIG. 11 show a third preferred embodiment. A basic piece 7 is made of hard synthetic resin and formed to have a substantially L-shaped cross-section. The basic piece 7 includes a base 7*a* having a linear cross-section, and one end of the base 7*a* is folded at the right angle to form a thick portion 7*b*. Further a tip of the thick portion 7*b* is folded at the right angle to form the L-shaped cross section. At a position below the tip by a prescribed interval is provided a L-shaped protruding piece opposite to the tip, to form an outer-piece engaging portion 7*c* having a C-shaped cross section between the tip and the protruding piece. Further, the base 7*a* has its inner surface portion composed of an elastic member 7*d* made of soft synthetic resin, rubber, or the like.

An outer covering piece 8 is made of hard synthetic resin and formed to have a substantially J-shaped cross section. One end of the outer covering piece is folded at the right angle, and from both ends of a folded piece are outwardly protruded hook-shaped basic-piece engaging portions 8*a*. A small protrusion 8*b* adjacent to the basic-piece engaging portion 8*a* is provided for aligning a pinching piece, and a small protrusion 8*c* having a L-shaped cross-section is provided located near the other end for aligning the pinching piece. Both protrusions 8*b* and 8*c* are protruded inward.

A card pinching piece 9 is made of elastic material such as chloroprene rubber, silicone rubber, or the like to be formed so as to have a prescribed length. This card pinching piece 9 is disposed and attached in a space formed by the basic piece 7 and the outer covering piece 8 with a predetermined space therefrom. The card pinching piece has a plate attachment portion 9*a* on the upper side, and a leg 9*b* protruding from the attachment portion 9*a* and sloped inward. And from the end of the leg 9*a*, a pinching portion 9*c* is extended outwardly in a trapezoid shape. An abutting end 9*d* of the pinching portion 9*c* against the basic piece is formed in a sawtooth-shape.

Figure 12:
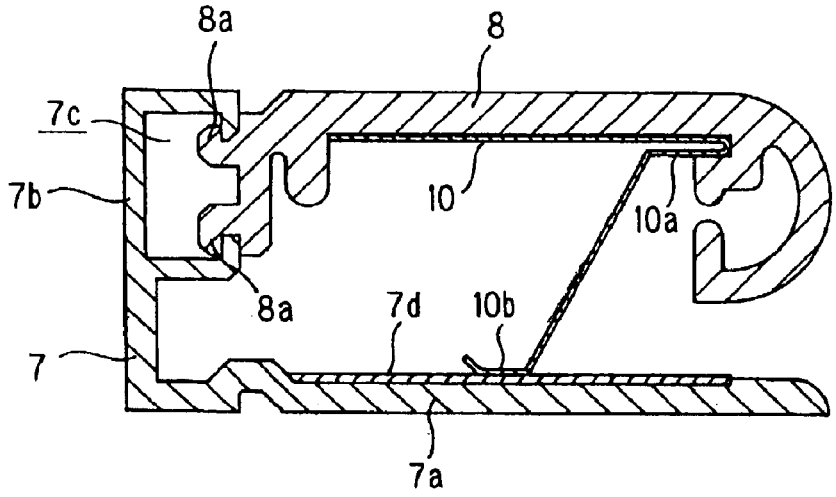
FIG. 12 is a sectional view of a card holder according to a fourth preferred embodiment of the present invention.
Figure 13:
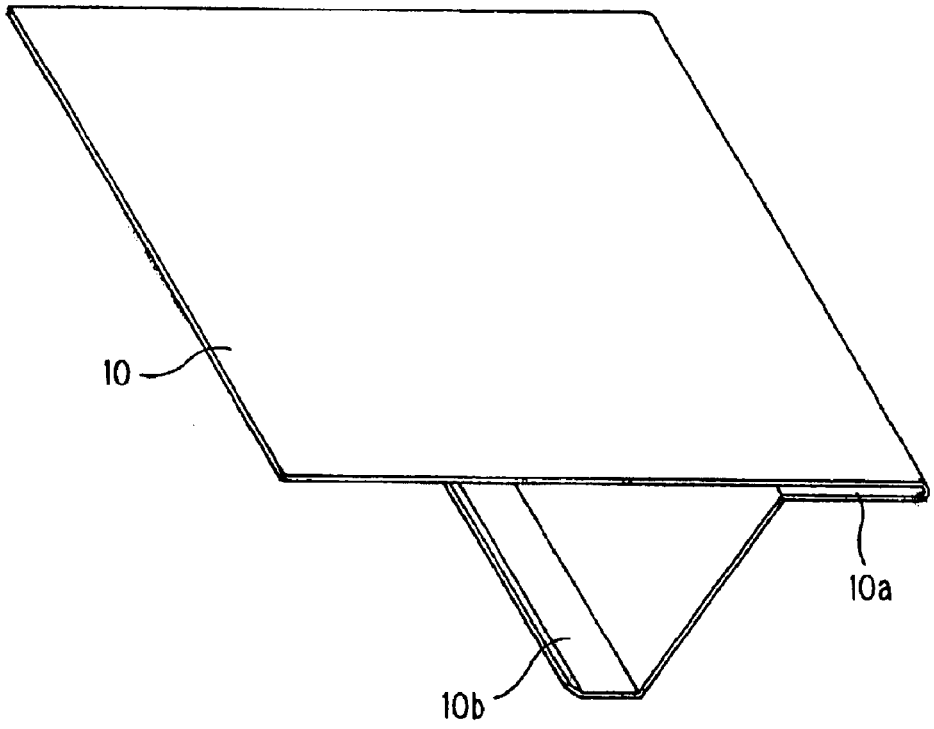
FIG. 13 is a perspective view of a plate spring according to the fourth preferred embodiment.
Figure 14:
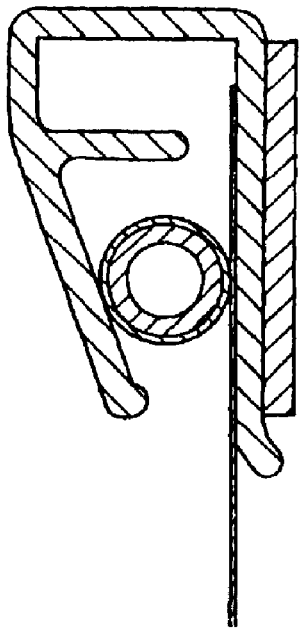
FIG. 14 is a sectional view of a conventional card holder.
Figure 15:
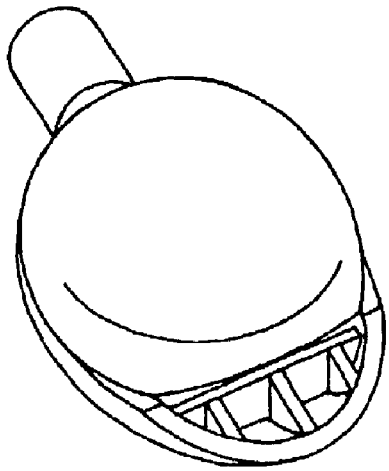
FIG. 15 is a perspective view of another conventional card holder.

FIG. 12 and FIG. 13 show a fourth preferred embodiment. In this embodiment, the same basic piece 7 and the outer covering piece 8 as those of the third embodiment are utilized, but a plate spring 10 is substituted for the card pinching piece 9 of the third embodiment.

The plate spring 10 is made of elastic material made of metal such as stainless steel, and has a flat end folded into an attachment portion 10*a*. The plate spring is further folded with a slope inward to form a card pinching portion, a tip of which is folded in parallel with the attachment portion 10*a* to form a pinching protrusion 10*b*.

Figure 16:
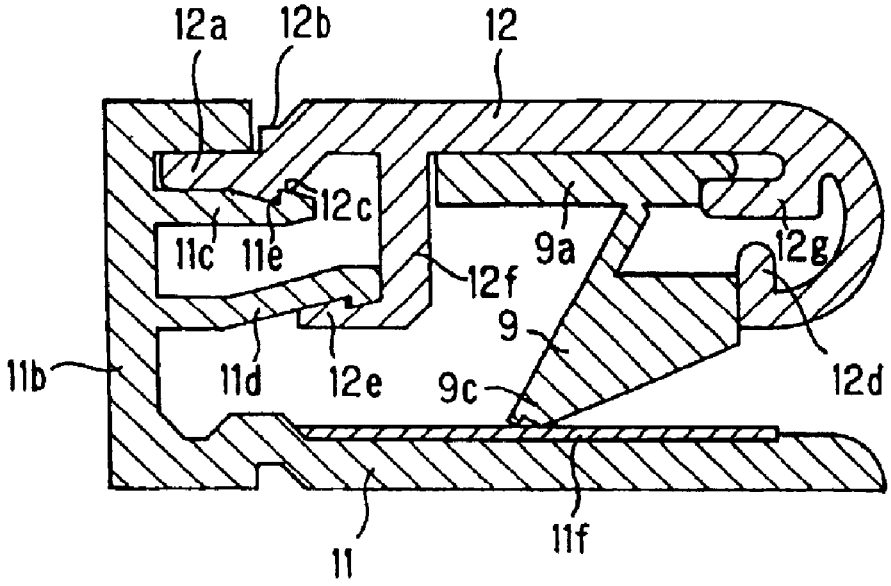
FIG. 16 is a sectional view of a card holder according to a fifth preferred embodiment of the present invention.

FIG. 16 shows a fifth preferred embodiment. A basic piece 11 is made of hard synthetic resin, and formed to have a L-shaped cross-section. The basic piece includes a flat base 11*a* in a linear shape. A basic end portion of the base 11*a* is folded at the right angle to form a thick portion 11*b*. A tip end of the thick portion is then folded at the right angle to form a L-shape. From this thick portion 11*b*, two protruding pieces 11*c* and 11*d* for engagement with the outer covering piece are protruded inward with a predetermined space therebetween. The protruding piece 11*c* is formed shortly in a cross-sectional linear manner. The outer-piece engaging portion has a reversed-V shaped engaging portion 11*e* which protrudes upward and which is formed by cutting out the upper side of the tip of the protruding piece. The protruding piece 11*d* for engagement with the outer covering piece is formed slightly long, and is folded upward from the middle point. The tip of the protruding piece 11*d* is extended in a hook-shaped manner. The base 11*a* has its inner surface composed of an elastic member 11*f* made of synthetic resin, rubber, or the like.

An outer covering piece 12 is made of hard synthetic resin, and formed to have a substantially J-shaped cross-section. The outer covering piece has a cross-sectionally linear engaging piece 12*a* formed on a basic end portion thereof. A small engaging protrusion 12*b* having a triangle-shaped cross-section is provided that protrudes outward, while an engagement cutout 12*c* having a triangle-shaped cross-section is provided that extends inward. The outer covering piece is sloped upward from there, and then is formed in a cross-sectionally flat and linear manner. The tip end of the outer covering piece is formed to have a half-round cross-section, whose tip end is then folded inward to form a card-pinching-piece retaining portion 12*d*. In the vicinity of the basic end portion, is protruded inward a L-shaped engaging piece 12*f*, a tip of which is extended in a cross-sectional triangle-shaped manner to form an engaging portion 12*e*. From the base having the tip in the half-round cross-section, is protruded inward a card-pinching-piece inserting portion 12*g* having a L-shaped cross-section.

Then, the folded tip of the basic end portion of the basic piece 11 is engaged with the small protrusion 12*b* for engagement of the outer covering piece 12. Subsequently the protruding pieces 11*c* and 11*d* for engagement are inserted between the basic end portion of the outer covering piece 12 and the engaging piece 11*f*, and their tips are engaged with the engagement cutout 12*c* and the engaging portion 12*e*, whereby the card holder is assembled. Between the L-shaped engaging piece 12*f* and card-pinching-piece inserting portion 12*g*, the card pinching piece 9 having the same construction as that of the third embodiment is attached to the outer covering piece via the attachment portion 9*a* with the pinching portion 9*c* abutting against the basic piece 11.

INDUSTRIAL APPLICABILITY

The present invention relates to card holders widely used to pinch or hold cards such as memo paper, a price list, or the like on shelves in stores, on walls of houses, in event halls, inside vehicles, or in other facilities, and thus having improved versatility.

What is claimed is:

1. A card holder comprising a basic base piece having a thick portion, an outer covering piece engaged with one end of said basic base piece so as to provide a card insertion opening on one side of the basic base piece, and a card pinching piece having elasticity and disposed in a space formed by the basic base piece and the outer covering piece, said card pinching piece being attached to said outer covering piece such that one end of the card pinching piece abuts against said basic base piece, wherein said basic base piece further comprises a base, a part of which is made of softer material than at least one of the outer covering piece, the card pinching piece and a remaining part of the base, so as to engage with a card, said thick portion being formed by folding from one end of said base, so that said basic base piece is formed to have a L-shaped cross-section, wherein said outer covering piece comprises a basic base-piece attachment portion for engaging with said thick portion of the basic base piece, an outer covering surface formed by folding from said basic base-piece attachment portion, and an outer covering tip end having a half-round cross-section, so that the outer covering piece is formed to have a J-shaped cross-section, wherein said card pinching piece is attached to a back surface of the outer covering surface, and wherein said card pinching piece is made of elastic material, and comprises an attachment portion for attachment to the outer covering piece and formed to have a linear cross-section, a leg protruding from said attachment portion, and a pinching portion extending from one end of said leg in a trapezoid shape, one end of said pinching portion serving as a basic base-piece abutting portion for abutting against the base piece and sloped in a direction of the card insertion opening.

2. The card holder according to claim 1, wherein said basic base-piece abutting portion has its tip end formed in a stepped shape, and said tip end has arc-shaped pits and projections formed in a mutually staggered configuration.

3. The card holder according to claim 1, wherein the elastic material includes rubber.

4. A card holder comprising:

an L-shaped base plate, said base plate having a first linear portion and a second linear portion joined to and orthogonally disposed with respect to a first end of the first linear portion, and comprising a first coupling structure, a second tip end of first linear portion defining a portion of a card receiving opening and having a material that is softer than the remaining material of the base plate a J-shaped outer cover, comprising at least a first linear portion with a second coupling structure at one end and a curved portion at an opposite end, the curved portion defining a portion of the card receiving opening at its tip end, wherein, the base plate and the outer cover, when joined by mating the first coupling structure and the second coupling structure, have the first linear portion of the base plate and the first linear portion of the outer cover disposed in parallel and define a U-shape having a cavity and defining the card receiving opening; and a resilient pincher structure mounted to the outer cover within the cavity and being operative to engage the base piece and the tip end of the curved portion of the outer cover.

5. The card holder of claim 4, wherein the pincher comprises an attachment portion and a trapezoidal pinching portion that are joined by a resilient leg, the leg being sized so that the pincher abuts against the plate.

6. The card holder of claim 5, wherein the end tip has arc-shaped pits and projections formed in a staggered manner.

* * * * *